United States Patent [19]

Hauser, Jr.

[11] 4,385,594

[45] May 31, 1983

[54] TWO-CIRCUIT COOLING SYSTEM AND PUMP FOR AN ENGINE

[75] Inventor: Herbert J. Hauser, Jr., Waterloo, Iowa

[73] Assignee: Deere & Company, Moline, Ill.

[21] Appl. No.: 289,543

[22] Filed: Aug. 3, 1981

[51] Int. Cl.[3] ..... F01P 3/12

[52] U.S. Cl. ..... 123/41.29; 123/41.46; 123/563; 415/87; 415/143; 415/198.1

[58] Field of Search ..... 123/41.29, 41.44–41.47, 123/559, 563; 60/599; 415/87, 143, 198.1, 62, 98, 170 A, 172 R, 173 R, 170 R; 416/184, 199

[56] References Cited

U.S. PATENT DOCUMENTS

| | | | |
|---|---|---|---|
| 1,229,274 | 6/1917 | Jack | 415/98 |
| 1,715,944 | 6/1929 | Oliver | 415/170 A |
| 2,760,468 | 8/1956 | Dolza | 123/41.1 |
| 3,080,857 | 3/1963 | Middendorf | 123/41.1 |
| 3,116,908 | 1/1964 | Wosika | 415/143 |
| 3,425,400 | 2/1969 | Scherenberg | 123/41.08 |
| 3,439,657 | 4/1969 | Gratzmuller | 123/41.31 |
| 4,061,187 | 12/1977 | Rajasekaran et al. | 123/41.29 |

*Primary Examiner*—William A. Cuchlinski, Jr.

[57] ABSTRACT

A two-circuit cooling system for an internal combustion engine including first and second fluid circuits. The first fluid circuit includes a radiator and a liquid cooled heat source while the second circuit includes a radiator and an air-to-liquid heat exchanger. A fluid pump is connected across the two circuits and facilitates independent movement of the coolant through the two separate circuits. The pump accomplishes this by using an impeller member having multiple vanes on two opposite surfaces which are of different configuration and which are divided by a wall which cooperates with the housing to form two separate fluid chambers.

7 Claims, 5 Drawing Figures

TWO-CIRCUIT COOLING SYSTEM AND PUMP FOR AN ENGINE

BACKGROUND OF THE INVENTION

1. Field of the Invention

This invention relates to a two-circuit cooling system for an internal combustion engine and a fluid pump used therein.

2. Description of the Prior Art

Cooling systems for use in vehicles and other machinery have been utilized for many years. The most common type used for vehicle engines is a high temperature circuit which effects the cooling of the motor proper. This circuit includes an engine water jacket, a circulation pump and a radiator. Three patents which describe various types of such engine cooling systems include: U.S. Pat. No. 2,760,468 issued to Dolza in 1956; U.S. Pat. No. 3,080,857 issued to Middendorf in 1963; and U.S. Pat. No. 3,425,400 issued to Scheremberg in 1969. With the advent of supercharged and turbocharged engines, an auxiliary low temperature circuit was added to cool the incoming air to the engine, and if necessary, the lubricating oil. Such an auxiliary circuit included an air-to-water heat exchanger, a circulation pump, a radiator and if necessary, an oil-to-water heat exchanger. U.S. Pat. No. 3,439,657 issued to Gratzmuller in 1969 teaches such a system. Up until now, virtually all dual cooling systems employed a pair of fluid pumps, primarily because each circuit operated at different temperatures and at different flow rates. The use of two pumps adds to the complexity and cost of the cooling system as well as decreasing the engine's overall efficiency.

Now a unique coolant pump has been invented which allows a two-circuit cooling system to be operational using a single pump.

SUMMARY OF THE INVENTION

Briefly, this invention relates to a two-circuit cooling system and pump for an internal combustion engine of the gasoline or diesel type. The cooling system includes a first fluid circuit having a radiator fluidly connected to a water jacket which surrounds the engine, a second fluid circuit having a second radiator fluidly connected to an air-to-water heat exchanger for cooling the incoming air to the engine, and a pump which is capable of circulating two separate and independent fluid flows through the respective fluid circuits.

The fluid pump, which can handle equal or different fluid flows through the two circuits is constructed with a rotatable impeller member which cooperates with the housing to form two independent and separate annular fluid chambers. The configuration of the impeller member includes a plurality of arcuately-shaped vanes on one side and a plurality of turbine shaped vanes on a second side, the two sides corresponding to the first and second annular fluid chambers. By changing the size, shape and number of vanes on each side of the impeller member, the fluid flow through the two fluid circuits can be adjusted.

The general object of this invention is to provide a two-circuit cooling system for an engine which utilizes a single fluid pump. A more specific object of this invention is to provide a cooling system for an engine which is simple in construction and economical to build.

Another object of this invention is to provide a fluid pump which can handle two separate and independent fluid flows.

Still another object of this invention is to provide a fluid pump which includes an impeller member having vanes on two opposite surfaces for permitting different flow capacities through a pair of separate fluid circuits.

A further object of this invention is to provide a two-circuit cooling system utilizing a single pump wherein the fluid temperature and flow rate in each circuit is different.

Other objects and advantages of the present invention will become more apparent to those skilled in the art in view of the following description and the drawings.

DETAILED DESCRIPTION OF THE PREFERRED EMBODIMENT

Figure 1:
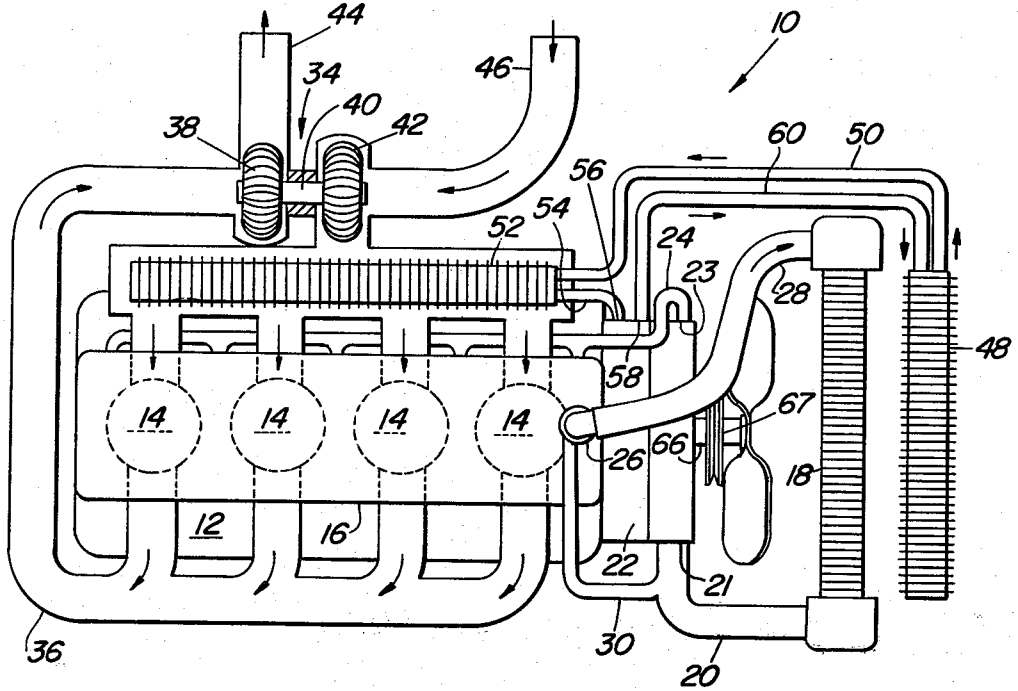
FIG. 1 is a schematic top view of an engine with an attached two-circuit cooling system.

Referring to FIG. 1, a two-circuit cooling system 10 is shown attached to an internal combustion engine 12. The engine 12 is depicted as having a plurality of cylinders 14 formed in an engine block 16. All of the cylinders 14 are surrounded by a water jacket which is internal to the engine block 16.

The cooling system 10 includes two separate and independent fluid circuits containing a coolant. The first fluid circuit includes a radiator 18 which is fluidly connected by a conduit 20 to an inlet port 21 leading into a fluid pump 22. The coolant exits the pump 22 via an outlet port 23 and is directed through a conduit 24 into the water jacket of the engine block 16. After the coolant has circulated through the water jacket of the engine 12, it passes through a thermostat 26 and is returned to the radiator 18 via a return line 28. A bypass line 30 is also present which bypasses the radiator 18, and directs the fluid into the pump 22 via the inlet port 21. The bypass line 30 becomes effective when the thermostat 26 prevents fluid flow through the radiator 18, such as during a cold startup mode.

The second fluid circuit of the cooling system 10 is useful on engines 12 which have a turbocharger 34. The purpose of the turbocharger 34 is to increase the amount of air available to the combustion chambers of the engine 12. By cooling the incoming air, a denser quantity of air can be provided for combustion. The turbocharger 34 operates by using the exhaust gases of the engine 12, which are directed through an exhaust manifold 36, to turn a turbine rotor 38 which is mounted on a rotatable shaft 40. As the turbine rotor 38 is rotated, it drives a compressor impeller 42 which is mounted on the same shaft 40. In such an operation, as the exhaust gases flow through the turbine rotor 38 and out through an exhaust pipe 44 to the atmosphere, the compressor impeller 42 is rotated. As the compressor impeller 42 revolves, fresh atmospheric air is drawn into an inlet pipe 46 and is compressed by the rotation of the compressor impeller 42. The second fluid circuit cools the incoming air from the turbocharger 34 before it enters the combustion chambers of the cylinders 14. This second fluid circuit includes a radiator 48 which is fluidly connected by a conduit 50 to a heat exchanger 52. The heat exchanger 52, shown in FIG. 1, and normally referred to as an intercooler, effects an air-to-liquid heat transfer without an intermingling of the two mediums, i.e., air and liquid. The coolant which has been increased in temperature, exits from the heat exchanger 52 and is conveyed by a conduit 54 to a second side of the pump 22 via an inlet port 56. After passing through the pump 22, the coolant exits through a second outlet port 58 and is routed back to the radiator 48 by a return line 60.

Sometimes an oil cooler (not shown) is mounted onto the engine 12 to cool the oil lubing the engine 12. When present, this oil cooler is most preferably connected across the conduit 54. In such an arrangement, the second fluid circuit would also serve to cool the engine oil.

Figure 2:
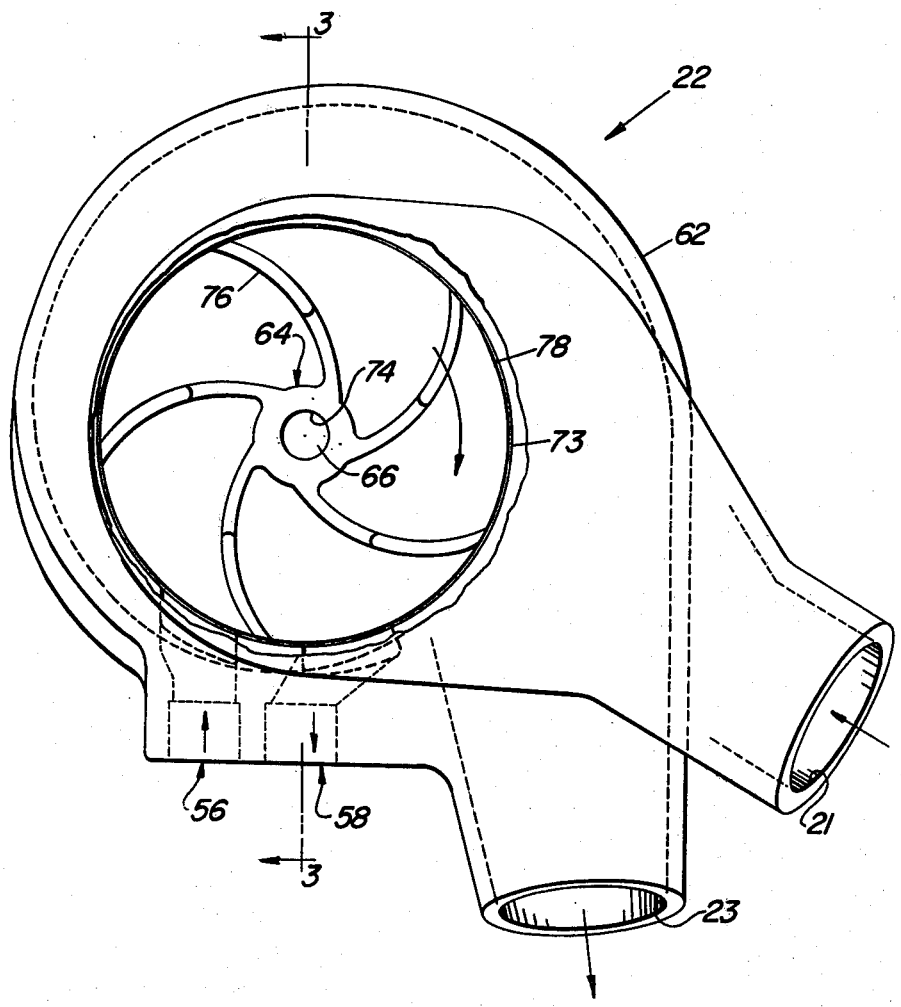
FIG. 2 is a front view of the fluid pump of this invention.
Figure 3:
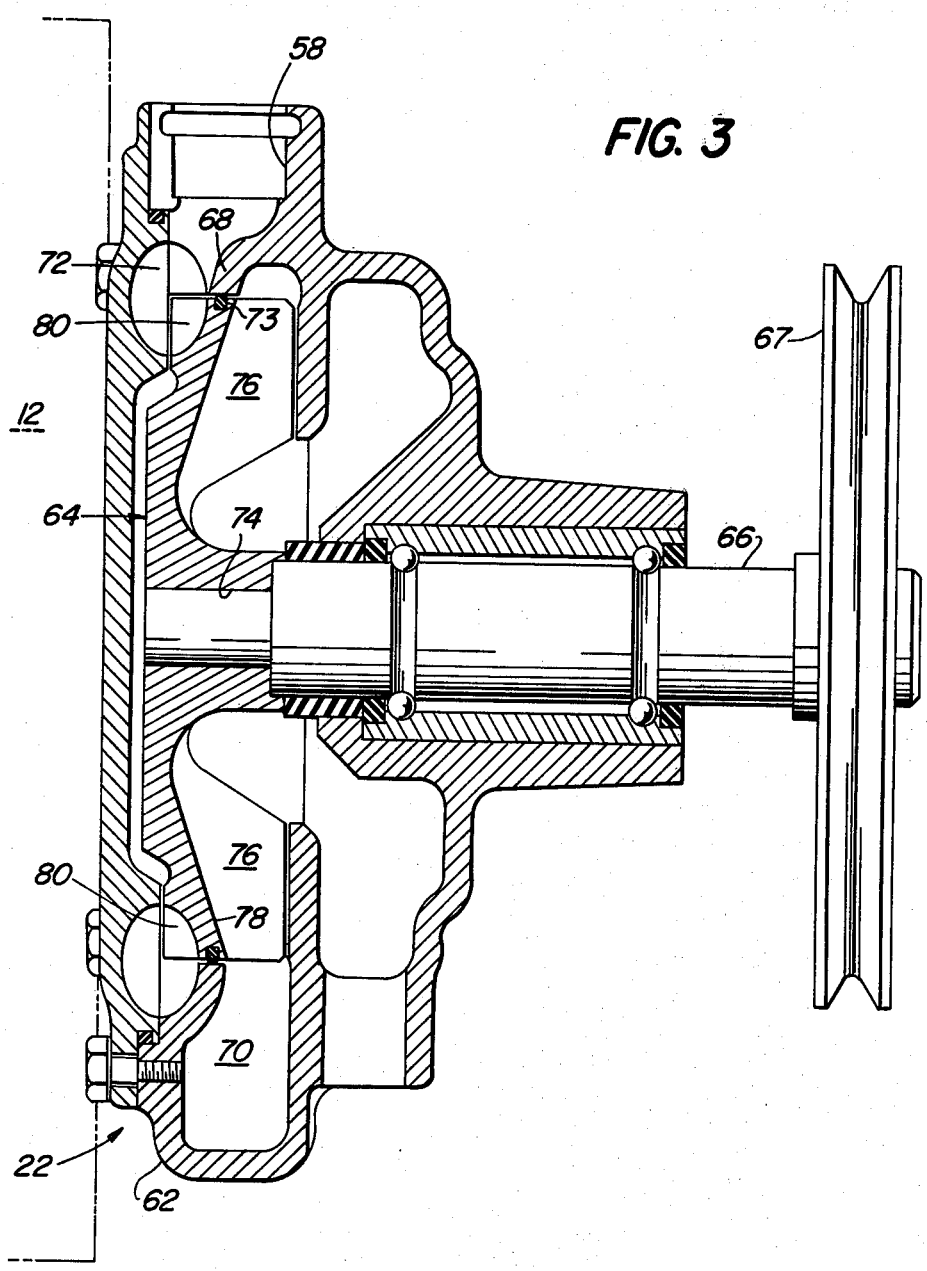
FIG. 3 is a cross-sectional view of FIG. 2 along the line 3—3.

Referring now to FIGS. 2 and 3, the fluid pump 22 of the cooling system 10 is shown having a housing 62 which contains a rotatable impeller member 64. The impeller member 64 is pressed onto a rotatable shaft 66 which carries a pulley 67. A belt looped around the pulley 67 and connected to a power driven shaft, such as a crankshaft, is employed to rotate the shaft 66. The impeller member 64 cooperates with an internal partition 68 located in the housing 62 to form first and second fluid chambers 70 and 72, respectively. The partition 68 can be separate or integral with the housing 62. The first fluid chamber 70 forms part of the first fluid circuit and communicates with the inlet port 21 and the outlet port 23 while the second fluid chamber 72 forms part of the second fluid circuit and communicates with the second inlet port 56 and the second outlet port 58. The first and second fluid chambers 70 and 72 are essentially separate and independent annular chambers whereby the only fluid transfer between the two chambers would result from leakage past a seal 73 circumscribing the periphery of the impeller member 64. The relative size of the two chambers can be equal or different but preferably the first chamber 70, which communicates with the water jacket of the engine 12, will be larger than the second chamber 72 which communicates with the air-to-liquid heat exchanger 52.

Figure 4:
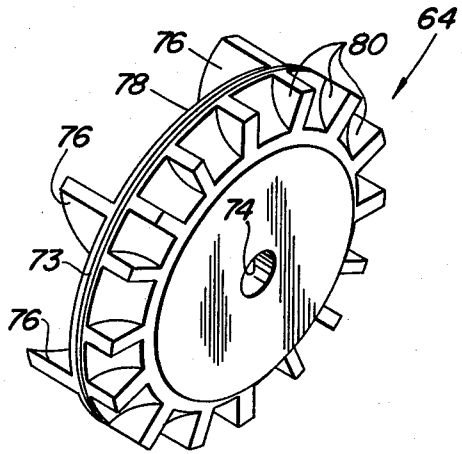
FIG. 4 is a perspective view of the impeller member of the pump showing the turbine-shaped vanes.
Figure 5:
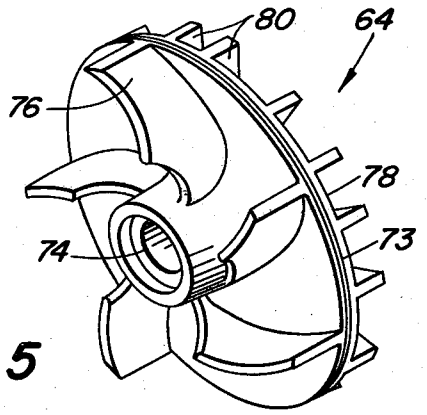
FIG. 5 is a perspective view of the impeller member of the pump showing the arcuately shaped vanes.

Referring now to FIGS. 4 and 5, the impeller member 64 is shown having a circular configuration with an axial opening 74 for mounting on the rotatable shaft 66. The impeller member 64 contains a plurality of relatively large arcuately shaped vanes 76 on one side of a dividing wall 78 and also a plurality of radial vanes 80 on the opposite side of the dividing wall 78. The arcuately shaped vanes 76 are positioned to move a fluid directed at approximate its central axis through the first fluid chamber 70 while the radial vanes 80 are positioned to move a fluid directed at approximate its outer periphery through the second fluid chamber 72. Preferably, the incoming fluid will be introduced perpendicular to the central axis of the impeller member 64. The dividing wall 78 of the impeller member 64, which supports the seal 73, is situated such that it aligns with the partition 68 and substantially prevents any transfer of coolant between the two chambers 70 and 72. It should be noted that the seal can alternatively be supported by the partition 68 as is well known to those skilled in the art.

Referring again to the embodiment shown in FIG. 3, the arcuately shaped vanes 76 cooperate with the first fluid chamber 70 to form a centrifugal pump which has a high fluid volume and a low fluid pressure while the radial, pie-shaped vanes 80 cooperate with the second fluid chamber 72 to form a turbine pump which has a low fluid volume and a high fluid pressure. This design is not a necessity but is preferred since the water jacket of the engine 12 contains relatively large fluid passages while the heat exchanger 52 has, comparatively speaking, narrow fluid passages. Therefore, the heat exchanger 52 requires a higher pressure to move the coolant through it than is needed to move the coolant through the water jacket of the engine 12. It should be noted however, that the first and second fluid chambers 70 and 72 can be of equal size and the vanes on the impeller member 64 can be of similar or different design depending on the use of the pump 22. For example, the vanes on both sides of the impeller member 64 can be arcuately shaped if this is desired.

The cooling system 10 and the pump 22 of this invention will theoretically function as follows on a turbocharged multi-cylinder diesel engine that has been brought up to normal operating temperature. Incoming atmospheric air, at approximately 100° F. (38° C.) and 14.5 psi, will be drawn into the compressor side of the turbocharger 34 via the intake pipe 46. This air is elevated in both temperature and pressure to about 350° F. (177° C.) at about 25 psi before passing through the air-to-liquid intercooler 52. The coolant in the second fluid circuit, having a temperature of approximately 140° F. (60° C.) and a pressure of about 30 psi, passes through coils of the intercooler 52 and is raised to about 150° F. (65.5° C.) while decreasing the air temperature to about 175° F. (80° C.). Simultaneously, the coolant in the first fluid circuit exits the radiator 18 at about 200° F. (93° C.) at about 15 psi and is pumped through the water jacket of the engine 12 wherein the coolant increases to about 210° F. (99° C.). The coolant in both of the fluid circuits is returned to the respective radiators, 18 and 48, wherein the fluid is cooled by the passing air stream before it is again circulated through the system 10.

While this invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. A cooling system for an engine comprising:

(a) first cooling means for cooling said engine;

(b) a first radiator fluidly connected to said first cooling means for holding a coolant;

(c) second cooling means for cooling incoming air to said engine;

(d) a second radiator fluidly connected to said second cooling means for holding a coolant;

(e) a housing enclosing a centrifugal pump for circulating said coolant between said first radiator and said first cooling means and a turbine pump for circulating said coolant between said second radiator and said second cooling means, said centrifugal pump and said turbine pump being integrally formed;

(f) a rotatable impeller member contained in and dividing said housing into first and second independent fluid chambers, with said first chamber being larger than said second chamber, said impeller member having a plurality of vanes on both sides thereof for facilitating the movement of a fluid through said first and second fluid chambers;

(g) a seal positioned between said housing and the periphery of said rotatable impeller for restricting fluid transfer between said first and second fluid chambers;

(h) first inlet and outlet ports communicating with said first fluid chamber for routing fluid therethrough; and (i) second inlet and outlet ports communicating with said second fluid chamber for routing fluid therethrough.

2. The cooling system of claim 1 wherein said seal is secured to the outer periphery of said rotatable impeller.

3. The cooling system of claim 1 wherein said vanes on one side of said impeller member are arcuately shaped vanes, and the vanes on the other side of said impeller member are radial vanes.

4. The cooling system of claim 1 wherein said centrifugal pump is a high volume, low pressure pump receiving a fluid stream approximate its central axis, and said turbine pump is a low volume, high pressure pump receiving a fluid stream approximate its outer periphery.

5. The cooling system of claim 1 wherein said impeller member is disk-shaped having several arcuately shaped vanes on one side and having a plurality of pie-shaped radial vanes on said other side.

6. A cooling system for an engine comprising:

(a) first cooling means for cooling said engine;

(b) a first radiator fluidly connected to said first cooling means for holding a coolant;

(c) second cooling means for cooling incoming air to said engine;

(d) a second radiator fluidly connected to said second cooling means for holding a coolant;

(e) pump means for circulating said coolant between said first radiator and said first cooling means and between said second radiator and said second cooling means, said pump means including a housing cooperating with an enclosed rotatable impeller member to form first and second independent fluid chambers with said first chamber being larger than said second chamber, said impeller member having arcuately shaped vanes on one side and radial vanes on the other side which cooperate with said housing to form a centrifugal pump on one side of said impeller member and a turbine pump on the other side of said impeller member;

(f) a seal positioned on the periphery of said rotatable impeller and cooperating with said housing for restricting fluid transfer between said first and second fluid chambers;

(g) first inlet and outlet passages fluidly connecting said first radiator to said first fluid chamber and said first fluid chamber to said first cooling means, respectively; and (h) second inlet and outlet passages fluidly connecting said second radiator to said second fluid chamber and said second fluid chamber to said second cooling means, respectively.

7. A two-circuit fluid pump, comprising:

(a) a housing;

(b) a rotatable impeller member enclosed in said housing having several arcuately shaped vanes on a first side, a plurality of radial vanes on a second side, and a disk-shaped wall in-between said first and second sides which supports a peripheral seal which cooperates with said housing to form first and second independent annular fluid chambers;

(c) first inlet and outlet ports communicating with said first annular fluid chamber for routing fluid therethrough; and (d) second inlet and outlet ports communicating with said second fluid chamber for routing fluid therethrough.

* * * * *